United States Patent [19]

Kolaska et al.

[11] Patent Number: 4,684,405

[45] Date of Patent: Aug. 4, 1987

[54] SINTERED TUNGSTEN CARBIDE MATERIAL AND MANUFACTURING METHOD

[75] Inventors: Johannes Kolaska, Bottrop; Norbert Reiter, Mettmann, both of Fed. Rep. of Germany

[73] Assignee: Fried. Krupp GmbH, Essen, Fed. Rep. of Germany

[21] Appl. No.: 845,589

[22] Filed: Mar. 28, 1986

[30] Foreign Application Priority Data

Mar. 28, 1985 [DE] Fed. Rep. of Germany ..... 3511220

[51] Int. Cl.[4] ..... C22C 29/08

[52] U.S. Cl. ..... 75/240; 75/241; 148/126.1; 419/15; 419/18; 419/29; 419/38; 419/53; 419/54; 419/57; 419/58; 419/60

[58] Field of Search ..... 419/15, 18, 29, 53, 419/38, 54, 57, 60, 58; 75/240, 241; 148/126.1

[56] References Cited

U.S. PATENT DOCUMENTS

| | | | |
|---|---|---|---|
| 3,215,510 | 11/1965 | Kelly et al. | 29/182.8 |
| 3,918,138 | 11/1975 | Nemeth et al. | 75/240 |
| 3,964,878 | 6/1976 | Scheithauer et al. | 419/15 |
| 4,024,902 | 5/1977 | Baum | 75/240 |
| 4,146,080 | 3/1979 | Baum | 75/240 |
| 4,276,096 | 6/1981 | Kolaska et al. | 419/15 |
| 4,466,829 | 8/1984 | Nishigaki et al. | 75/240 |
| 4,497,660 | 2/1985 | Lindholm | 75/236 |

OTHER PUBLICATIONS

R. Kieffer et al, "Hartmetalle", 1965, Springer-Verlag, Vienna/New York, pp. 220, 221 and 228.

*Primary Examiner*—Stephen J. Lechert, Jr.
*Attorney, Agent, or Firm*—Spencer & Frank

[57] ABSTRACT

A sintered tungsten carbide material and method for manufacturing same in which the method includes the steps of combining metal particles composed of from 75 to 95 percent by weight of a composition containing at least 70 percent by weight of tungsten carbide and from 5 to 25 percent by weight of a binder metal composition, the binder metal composition consisting essentially of from 5 to 15 percent by weight of chromium and from 85 to 95 percent by weight of nickel; pressing the metal particles into a pressed body; sintering the pressed body in a sintering chamber for a period ranging from 20 to 200 minutes, at a temperature ranging from 1400° to 1500° C., and in a protective atmosphere which is one of a vacuum, a noble gas, a mixture of noble gases, and hydrogen gas to form a sintered body; and treating the sintered body for a period ranging from 20 to 200 minutes, at a temperature ranging from 1300° to 1400° C., at a pressure ranging from 20 to 3000 bar, and in a noble gas atmosphere. The pressure/temperature treatment step densifies the sintered composition and results in an unexpectedly stronger and tougher sintered metal.

10 Claims, No Drawings

SINTERED TUNGSTEN CARBIDE MATERIAL AND MANUFACTURING METHOD

BACKGROUND OF THE INVENTION

1. Field of the Invention

The present invention relates to a sintered metal having a hard substance phase comprised of tungsten carbide and a binder metal phase comprised of nickel and chromium which is produced by pressing and sintering particulate raw materials, and to a method for manufacturing same.

2. Discussion of the Prior Art

Sintered metals composed of tungsten carbide and binder alloys are known. U.S. Pat. No. 3,215,510 discloses a sintered metal composed of from 10 to 30 weight % of a chromium-nickel-binder alloy and the remainder tungsten carbide, with the weight ratio of chromium to binder alloy lying between 0.015 and 0.15. This sintered metal is manufactured by pressing powdered raw materials into a pressed body which is then subjected to sintering. A publication by Kieffer and Benesovsky entitled *Hartmetalle,* Springer-Verlag, Vienna/New York, 1965, at pages 220, 221 and 228, also discloses a sintered metal composed of 90 weight % tungsten carbide, 8 weight % nickel and 2 weight % chromium. Although these known sintered metals have good corrosion resistance, their strength and toughness are poor, and, in particular, their bending strength is very poor so that their usefulness is greatly limited.

SUMMARY OF THE INVENTION

It is an object of the present invention to provide a sintered tungsten carbide material of the above-mentioned sintered metal type which, in addition to good corrosion resistance, also has great strength and toughness and, in particular, great bending strength. It is a further object of the invention to provide a method for manufacturing such a hard, sintered metal.

These objects are accomplished by providing a sintered tungsten carbide material and a method for manufacturing a sintered tungsten carbide material, the method including the steps of combining metal particles composed of from 75 to 95 percent by weight of a composition containing at least 70 percent by weight of tungsten carbide and from 5 to 25 percent by weight of a binder metal composition, the binder metal composition consisting essentially of from 5 to 15 percent by weight of chromium and from 85 to 95 percent by weight of nickel; pressing the metal particles into a pressed body; sintering the pressed body in a sintering chamber for a period ranging from 20 to 200 minutes, at a temperature ranging from 1400° to 1500° C., and in a protective atmosphere which is one of a vacuum, a noble gas, a mixture of noble gases, and hydrogen gas to form a sintered body; and treating the sintered body for a period ranging from 20 to 200 minutes, at a temperature ranging from 1300° to 1400° C., at a pressure ranging from 20 to 3000 bar, and in a noble gas atmosphere.

The tunsten carbide composition may consist essentially of from 1 to 30 percent by weight of a compound selected from the group consisting of titanium carbide, tantalum carbide, niobium carbide and mixtures thereof, and from 70 to 99 percent by weight of tungsten carbide.

The method may include the further step of cooling the sintered body prior to the treating step, and the treating step is then conducted in a treating chamber which is separate from the sintering chamber and at a pressure ranging from 100 to 3000 bar or, alternately, the treating step may immediately follow the sintering step and may be advantageously conducted at a pressure ranging from 20 to 100 bar.

DESCRIPTION OF THE PREFERRED EMBODIMENTS

The sintered tungsten carbide material according to the present invention is a hard, sintered metal which is corrosion resistant, has great strength and toughness, and, in particular, great bending strength. Moreover, the present invention's sintered materials are surprisingly stronger and tougher than prior art sintered tungsten carbide cobalt materials, which heretofore had the highest known strength and toughness values for hard, sintered metals, as will be demonstrated in the following. Further, the sintered materials according to the present invention are conveniently always nonmagnetic, which is not always the case with prior art sintered metals. These superior characteristics of the present sintered tungsten carbide materials result in their usefulness in applications heretofore not possible.

The metal particles employed for the production of the sintered material are preferably powdered raw materials, and most preferably have a particle size ranging from 0.5 to 5μ. Pressing and sintering of the metal particles is effected according to known methods. Prior to pressing and sintering, however, the metal particles are combined.

The tungsten carbide material has a hard substance phase and a binder metal phase. The hard substance phase consists of a composition containing at least 70 percent by weight of tungsten carbide and the material contains from 75 to 95% by weight of the tungsten carbide composition. The binder metal phase consists of from 5 to 15 percent by weight of chromium and the remainder nickel. The composition of the material may be altered somewhat, while still achieving the desired superior characteristics, and may thus be adapted to specific applications by including from 1 to 30 weight % of titanium carbide, tantalum carbide, niobium carbide, or mixtures thereof.

The combined metal particles are pressed into a pressed body according to known methods. Similarly, the sintering of the pressed body is accomplished by known methods. Preferably, sintering takes place at a temperature ranging from 1400° to 1500° C., in a protective atmosphere and for a period ranging from 20 to 200 minutes. The protective atmosphere may be a vacuum, a noble gas, a mixture of noble gases, or hydrogen gas. The sintering results in a sintered body which is then treated in a pressure-temperature treatment which is unique to the present invention. The sintered body is treated at a temperature ranging from 1300° to 1400° C., at a pressure ranging from 20 to 3000 bar and for a period ranging from 20 to 200 minutes. The treatment takes place in a noble gas atmosphere, preferably an argon atmosphere. It is this treatment which imparts the unexpectedly good strength and toughness to the sintered tungsten carbide materials. The treatment increases the density of the sintered metal.

The densities of the intermediate sintered bodies and of the treated end products differ only very slightly from one another. For example, for the test results reported in the Table on page 9 the intermediate sintered body of Example 1 had a density of 14.58 g/cm$^3$. After the pressure-temperature treatment, this value increased only slightly to 14.59 g/cm$^3$. The end products thus have only a slightly higher density than the intermediate sintered bodies. The results for bending strength, however, are quite different. The intermediate sintered body of Example 1 had a bending strength of 2200N/mm$^2$. The bending strength of the end product after the pressure-temperature treatment quite unexpectedly had risen to a value of 4050N/mm$^2$.

The densification treatment may take place in a separate system, i.e., treatment chamber, which is separate from the sintering system, i.e., sintering chamber, and at a pressure ranging from 100 to 3000 bar. In the foregoing embodiment, the sintered bodies are thus cooled prior to the treating step. In an alternate embodiment, the sintered bodies may be treated immediately after sintering, while still in the sintering system, and at a pressure of from 20 to 100 bar. In this latter embodiment, it is possible to advantageously operate at a particularly low pressure.

During the pressure-temperature treatment according to the invention, a pressure of at least 20 bar is necessary in order for the structure to become dense enough. Similarly, the treatment temperature should not exceed 1400° C. since the structure would become disadvantageously coarse. Further, if the chromium content of the binder metal composition is greater than 15 weight %, chromium carbide precipitates within the sintered hard metal structure and causes the characteristics of the sintered composition to become lastingly worse.

The following Table presents the results of bending strength tests performed on four sintered materials according to the present invention, Examples 1, 2, 4 and 5, as compared to two sintered tungsten carbide cobalt materials, Examples 3 and 6. Bending strength is a measure of strength and toughness of sintered metals. The comparison of bending strengths reveals the excellent characteristics of the sintered materials according to the present invention.

To produce the sintered materials listed in the Table on page 9, pressed bodies were initially produced from the powdered raw materials. The pressed bodies were then sintered for one hour in a vacuum of $10^{-1}$ to $10^{-2}$ mbar. For Samples 1 to 3 the sintering temperature was 1450° C. and for Samples 4 to 6 the sintering temperature was 1420° C. The sintered bodies were then cooled and subsequently treated for one hour at 1400° C. and 2000 bar in an argon atmosphere. The bending strength of the six samples was determined by means of the 3-point method according to ISO Standard 3327.

TABLE

| Example Number | Tungsten Carbide | Binder Metal Composition | | Bending Strength [N/mm$^2$] |
|---|---|---|---|---|
| 1 | 90.5 wt % | 9.5 wt %: | 10.5 wt % Cr, 89.5 wt % Ni | 4050 |
| 2 | 90.5 wt % | 9.5 wt %: | 5.3 wt % Cr, 94.7 wt % Ni | 3700 |
| 3 | 90.5 wt % | 9.5 wt %: | 100 wt % Co | 2350 |
| 4 | 85 wt % | 15 wt %: | 10.5 wt % Cr, 89.5 wt % Ni | 4100 |
| 5 | 85 wt % | 15 wt %: | 5.3 wt % Cr, 94.7 wt % | 4000 |
| 6 | 85 wt % | 15 wt %: | 100 wt % Co | 2700 |

It will be understood that the above description of the present invention is susceptible to various modifications, changes and adaptations, and the same are intended to be comprehended within the meaning and range of equivalents of the appended claims.

What is claimed is:

1. A method for manufacturing a sintered tungsten carbide material, comprising:

combining metal particles composed of: from 75 to 95 percent by weight of a composition containing at least 70 percent by weight of tungsten carbide; and from 5 to 25 percent by weight of a binder metal composition, the binder metal composition consisting essentially of from 5 to 15 percent by weight of chromium and from 85 to 95 percent by weight of nickel;

pressing the metal particles into a pressed body;

sintering the pressed body in a sintering chamber for a period ranging from 20 to 200 minutes, at a temperature ranging from 1400° to 1500° C., and in a protective atmosphere which is one of a vacuum, a noble gas, a mixture of noble gases, and hydrogen gas to form a sintered body; and treating the sintered body for a period ranging from 20 to 200 minutes, at a temperature ranging from 1300° to 1400° C., at a pressure ranging from 20 to 3000 bar, and in a noble gas atmosphere.

2. The method according to claim 1, including the further step of cooling the sintered body prior to the treating step, and wherein the treating step is conducted in a treating chamber which is separate from the sintering chamber and at a pressure ranging from 100 to 3000 bar.

3. The method according to claim 1, wherein the treating step immediately follows the sintering step and is conducted at a pressure ranging from 20 to 100 bar.

4. The method according to claim 1, wherein the tungsten carbide composition consists essentially of from 1 to 30 percent by weight of a compound selected from the group consisting of titanium carbide, tantalum carbide, niobium carbide and mixtures thereof, and from 70 to 99 percent by weight of tungsten carbide.

5. The method according to claim 1, wherein the noble gas atmosphere for the treating step is an argon atmosphere.

6. A sintered tungsten carbide material prepared by a method comprising:

combining metal particles composed of: from 75 to 95 percent by weight of a composition containing at least 70 percent by weight of tungsten carbide; and from 5 to 25 percent by weight of a binder metal composition, the binder metal composition consisting essentially of from 5 to 15 percent by weight of chromium and from 85 to 95 percent by weight of nickel;

pressing the metal particles into a pressed body;

sintering the pressed body in a sintering chamber for a period ranging from 20 to 200 minutes, at a temperature ranging from 1400° to 1500° C., and in a protective atmosphere which is one of a vacuum, a noble gas, a mixture of noble gases, and hydrogen gas to form a sintered body; and treating the sintered body for a period ranging from 20 to 200 minutes, at a temperature ranging from 1300° to 1400° C., at a pressure ranging from 20 to 3000 bar, and in a noble gas atmosphere.

7. The sintered tungsten carbide material prepared by the method according to claim 6, including the further step of cooling the sintered body prior to the treating step, and wherein the treating step is conducted in a treating chamber which is separate from the sintering chamber and at a pressure ranging from 100 to 3000 bar.

8. The sintered tungsten carbide material prepared by the method according to claim 6, wherein the treating step immediately follows the sintering step and is conducted at a pressure ranging from 20 to 100 bar.

9. The sintered tungsten carbide material prepared by the method according to claim 6, wherein the tungsten carbide composition consists essentially of from 1 to 30 percent by weight of a compound selected from the group consisting of titanium carbide, tantalum carbide, niobium carbide and mixtures thereof, and from 70 to 99 percent by weight of tungsten carbide.

10. The sintered tungsten carbide material prepared by the method according to claim 6, wherein the noble gas atmosphere for the treating step is an argon atmosphere.

* * * * *